US007507192B2

(12) United States Patent
Teeter et al.

(10) Patent No.: US 7,507,192 B2
(45) **Date of Patent: *Mar. 24, 2009**

(54) POWER DRIVEN TILTING INVERSION EXERCISER

(76) Inventors: Roger C. Teeter, 20720 Snag Island Dr., Sumner, WA (US) 98390; Lo Pin Wang, 16F-2, No. 17, Lane 52, Sec. 3, Rehe Road, Beitun Chu, Taichung 40652 (TW)

( * ) Notice: Subject to any disclaimer, the term of this patent is extended or adjusted under 35 U.S.C. 154(b) by 24 days.

This patent is subject to a terminal disclaimer.

(21) Appl. No.: 11/434,459

(22) Filed: May 15, 2006

(65) Prior Publication Data

US 2007/0265149 A1 Nov. 15, 2007

(51) Int. Cl.
*A63B 26/00* (2006.01)

(52) U.S. Cl. ..... 482/144; 482/145

(58) Field of Classification Search ..... 482/146–7, 482/144–145

See application file for complete search history.

(56) References Cited

U.S. PATENT DOCUMENTS

| | | | | |
|---|---|---|---|---|
| 5,885,197 | A | 3/1999 | Barton | 482/144 |
| 7,112,167 | B2 * | 9/2006 | Kim | 482/145 |
| 2006/0046915 | A1 * | 3/2006 | Huang | 482/145 |

* cited by examiner

*Primary Examiner*—Lori Amerson
(74) *Attorney, Agent, or Firm*—Charles E. Baxley

(57) ABSTRACT

A tilting inversion exerciser includes a table rotatably supported on a supporting stand for supporting a user, two pivot coupling devices each having a middle axle for pivotally attaching to the supporting stand and each having one arm secured to the side portions of the table for offsetting the table from the axles of the pivot coupling devices, and a rotating device for rotating the pivot coupling device relative to the supporting stand, to rotate the table relative to the supporting stand. The table and the user may be supported and located on or closer to the center of gravity of the supporting stand, for being stably supported on the supporting stand particularly when the user is conducting the inversion exercises.

7 Claims, 6 Drawing Sheets

POWER DRIVEN TILTING INVERSION EXERCISER

BACKGROUND OF THE INVENTION

1. Field of the Invention

The present invention relates to a tilting inversion exerciser, and more particularly to a tilting inversion exerciser having a power driving or rotating device for rotating the tilting inversion exerciser relative to the supporting stand.

2. Description of the Prior Art

Typical tilting inversion exercisers comprise a base or table pivotally or rotatably supported on a lower support stand, for supporting a user thereon, and for allowing the user to tilt or to incline the table relative to the lower support, in order to conduct the typical tilting inversion exercises.

For example, U.S. Pat. No. 5,885,197 to Barton discloses one of the typical rotatable or tilting inversion exercisers comprising a stationary support frame, a pivot frame attached to the stationary support frame with a pivoting frame, a sled slidably mounted on the frame, and a motor-driven device engaged with the sled to move the sled relative to the stationary support frame, and to maintain the pivoting frame at a selected angle relative to the stationary support frame.

Normally, the sled and/or the pivoting frame includes a middle or center portion pivotally attached to the stationary support frame with the pivoting frame for stably support the user on the sled. However, once or after the user is positioned on the sled, the center of gravity of both the sled and the user will be offset from the center of gravity of the stationary support frame, such that the sled and the user may not be stably supported on the stationary support frame and will form an unstable condition.

In addition, the motor-driven device includes a flexible metal cable having two ends for coupling to two end portions of the sled for driving or rotating the sled and the user relative to the stationary support frame to various angular positions. However, with this arrangement, the sled and the user may not be tilted to an upright position or vertical position that is perpendicular to the ground or perpendicular to the stationary support frame, such that the user may not conduct the inversion exercises.

U.S. Patent Application Publication No. US2004/0157714A1 to Huang discloses another typical electric exerciser machine for tilting and inverting human body also comprising a rotatable frame pivotally or rotatably attached to top and supported on a lower support member with a pivoting tube, and a driving device mounted on the support member and having an electric motor for driving or rotating or tilting the rotatable frame relative to the lower support member.

The driving device includes a motor-driven worm engaged with a worm gear which is attached or coupled to the pivoting tube of the rotatable frame. However, the motor-driven worm may suffer a great torque formed or applied by both the rotatable frame and the user due to the directly engagement of the motor-driven worm with the worm gear of the pivoting tube, such that the motor-driven worm of the driving device may be easily and quickly broken or damaged.

The present invention has arisen to mitigate and/or obviate the afore-described disadvantages of the conventional tilting inversion exercisers.

SUMMARY OF THE INVENTION

The primary objective of the present invention is to provide a tilting inversion exerciser including a power rotating or driving device for rotating the tilting inversion exerciser relative to the supporting stand and for allowing the table to be rotated relative to the lower support to a vertical position relative to the lower support and the ground, and for allowing the user to conduct the inversion exercises.

The other objective of the present invention is to provide a tilting inversion exerciser including a supporting table for stably supporting a user thereon and for allowing the center of gravity of both the supporting table and the user to be located on or closer to the center of gravity of the supporting stand, and thus for stably supporting both the supporting table and the user on the supporting stand particularly when the user is conducting the inversion exercises.

In accordance with one aspect of the invention, there is provided a tilting inversion exerciser comprising a supporting stand, a table for supporting a user thereon, the table including two side portions, two pivot coupling devices each including an axle provided on a middle portion thereof for pivotally attaching to the supporting stand, and each including a first arm extended therefrom and secured to the side portions of the table respectively, for allowing the table to be offset from the axles of the pivot coupling devices, and a rotating device for rotating the pivot coupling device relative to the supporting stand, to rotate the table relative to the supporting stand.

The supporting stand includes two bearing supports disposed on an upper portion of the supporting stand for pivotally attaching the axles. The table includes an ankle holder attached thereto, for securing ankle portions of the user to the table.

A first pivot coupling device of the pivot coupling devices includes a second arm extended therefrom, the rotating device includes a motor-driven threaded member for coupling to the second arm of the first pivot coupling device for rotating the pivot coupling device and the table relative to the supporting stand.

The rotating device includes a tube coupled to the second arm of the first pivot coupling device and threaded with the threaded member. The second arm of the first pivot coupling device includes a bracket provided on a free end portion for coupling to the tube.

The rotating device includes a motor attached to the supporting stand, and the threaded member is coupled to and rotated and driven by the motor. The rotating device includes a sleeve extended from the motor and engaged onto the threaded member for shielding and protecting the threaded member. The first arm and the second arm of the first pivot coupling device form an L-shaped structure.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
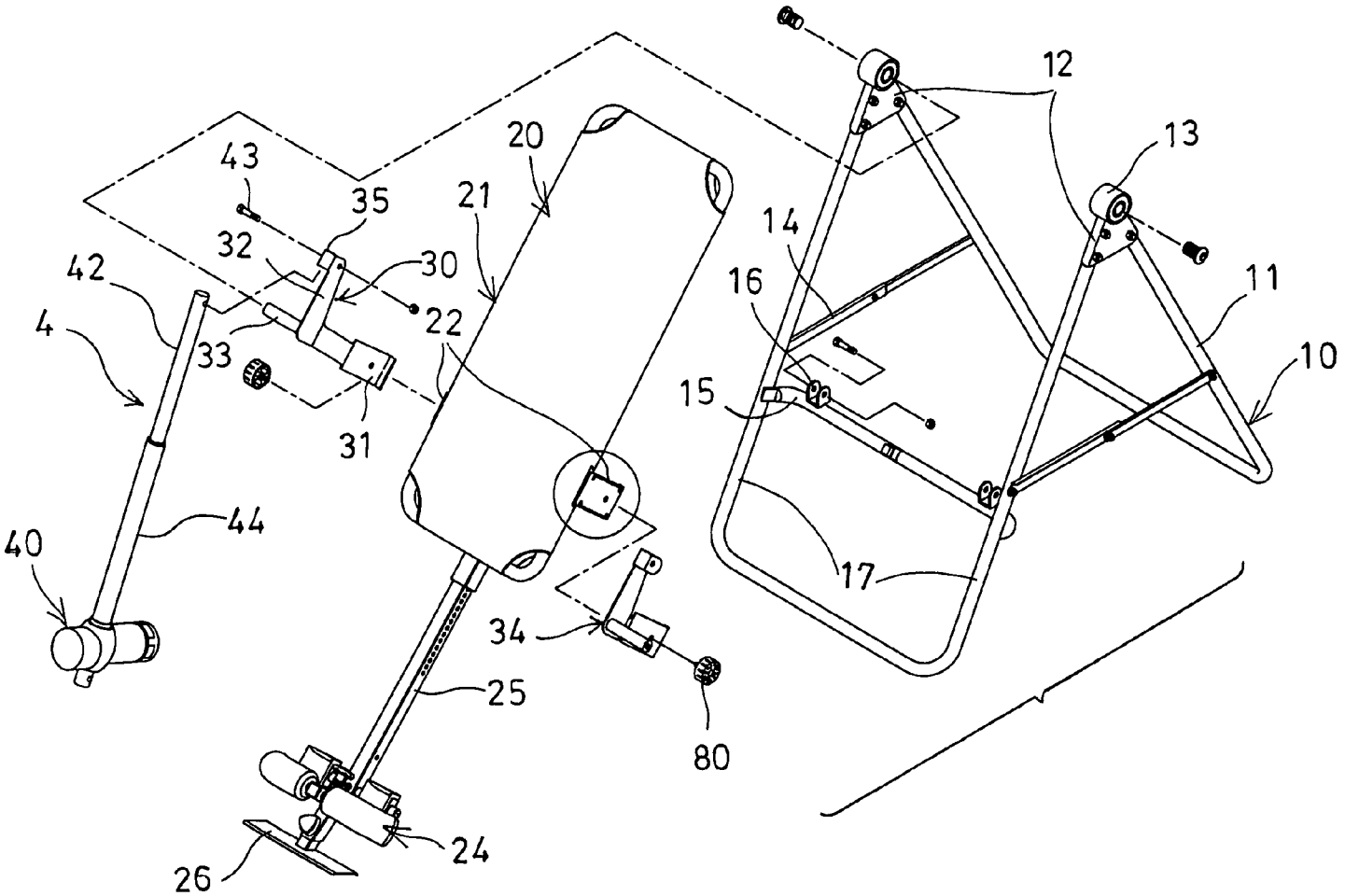
FIG. 1 is an exploded view of a tilting inversion exerciser in accordance with the present invention.
Figure 2:
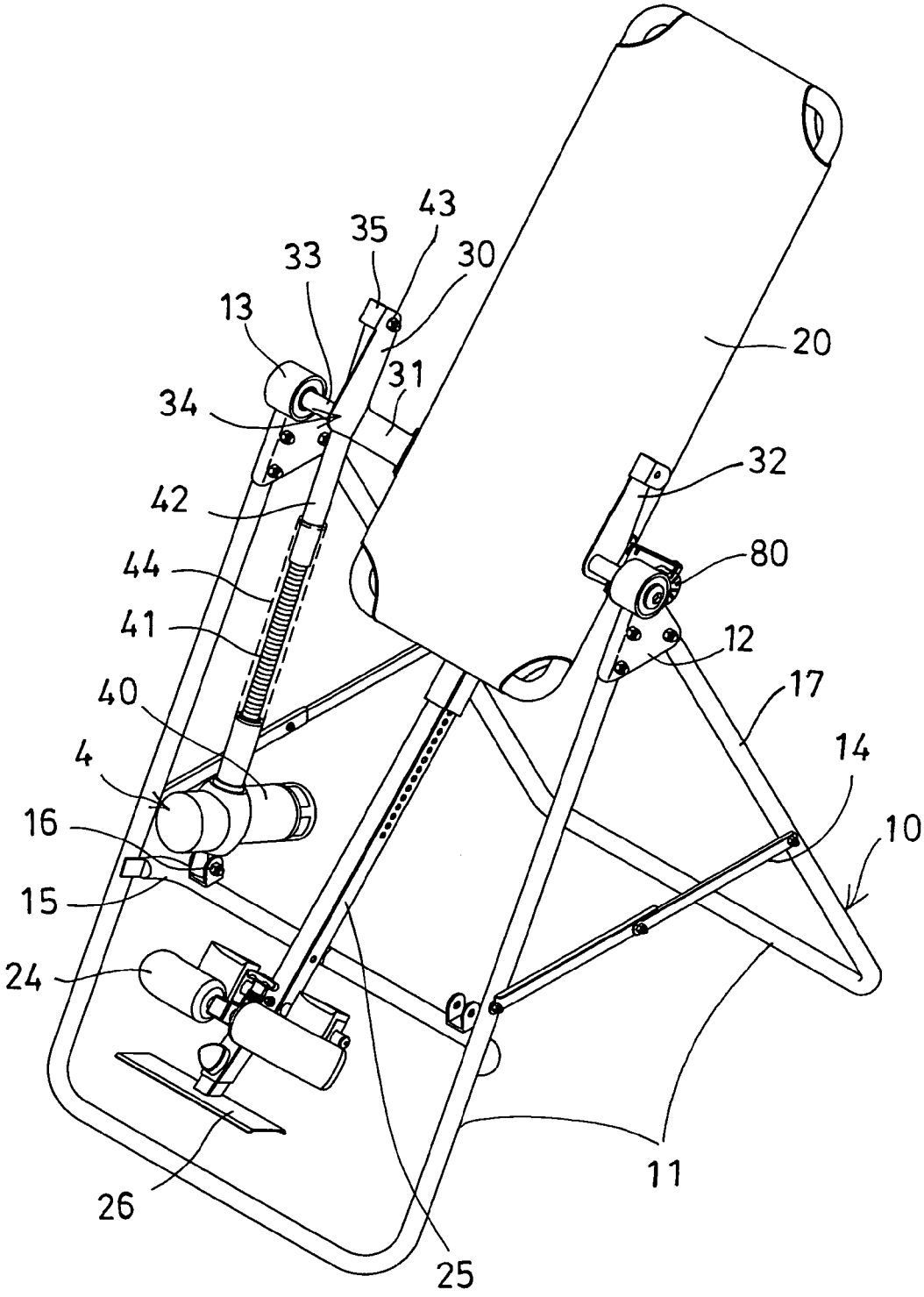
FIG. 2 is a perspective view of the tilting inversion exerciser.
Figure 4:
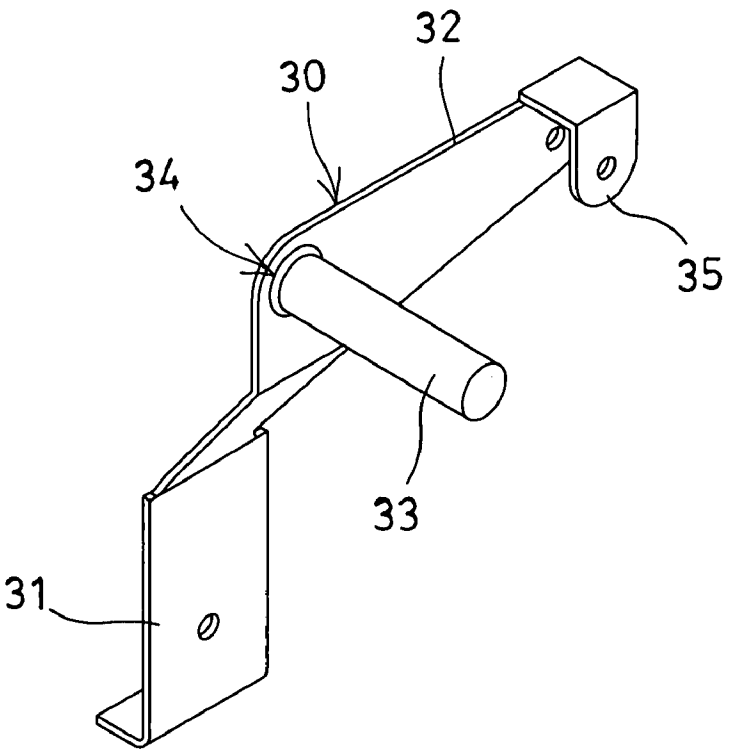
FIG. 4 is a perspective view similar to FIG. 3, illustrating another pivot coupling device for coupling the supporting table to the stationary supporting stand of the tilting inversion exerciser.
Figure 3:
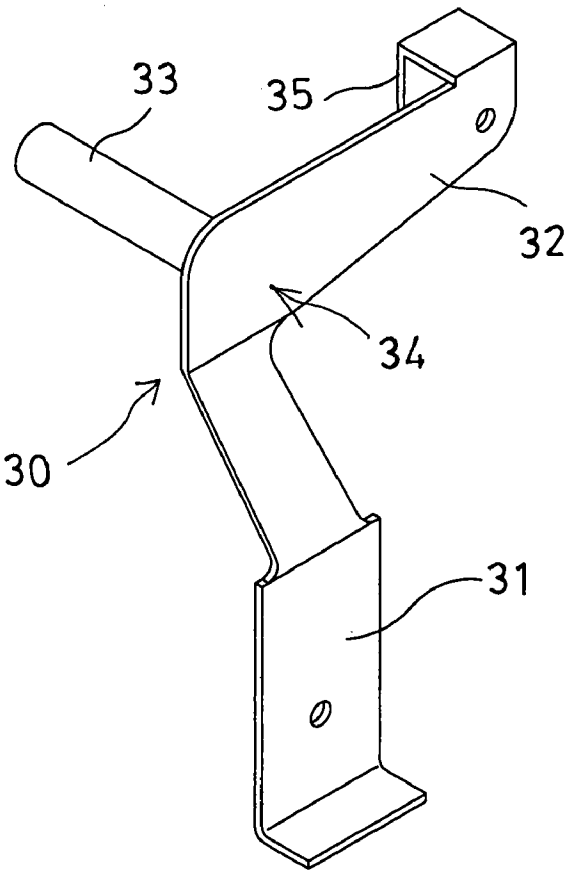
FIG. 3 is a perspective view illustrating a pivot coupling device for coupling the supporting table to the stationary supporting stand of the tilting inversion exerciser.

Referring to the drawings, and initially to FIGS. 1 and 2, a tilting inversion exerciser in accordance with the present invention comprises a lower supporting stand 10 for pivotally or rotatably supporting a supporting base or table 20 thereon, and then for supporting a user on the supporting table 20, the lower supporting stand 10 includes such as two U-shaped frames 11 having upper ends pivotally coupled together with two apex members 12 so as to form a substantially inverted V-shaped structure. The lower supporting stand 10 includes a bearing support 13 disposed or attached to each of the apex members 12 for pivotally or rotatably supporting or coupling the supporting table 20.

The lower supporting stand 10 includes one or more, such as two foldable coupler 14 coupled between the frames 11 for allowing the frames 11 of the supporting stand 10 to be folded to a compact folding structure when the foldable coupler 14 is folded, and for allowing the frames 11 of the supporting stand 10 to be stably supported on a working position when the foldable coupler 14 is opened or unfolded to an open position. The lower supporting stand 10 further includes a lever 15 coupled between the legs 17 of one of the frames 11, and one or more brackets 16 attached onto the lever 15.

The table 20 includes two opposite side portions 21, and includes a flap 22 attached or secured to each of the side portions 21 of the table 20. The table 20 further includes an ankle holder 24 adjustably attached or secured or coupled to the lower portion of the table 20 with an adjustable extension 25, for detachably securing the ankle portions of the user to the table 20, and a foot pedal 26 attached to the ankle holder 24 or the adjustable extension 25, for supporting the user thereon. The ankle holder 24 may be operated with various kinds of motorized actuating device (not shown) which is typical and will not be described in further details.

One or more, such as two pivot coupling devices 30 are provided for coupling the supporting table 20 to the stationary supporting stand 10, and include one or first arm 31 for securing to the respective side portion 21 of the table 20 with one or more fasteners 80, and another or second arm 32 bent relative to the arm 31 for forming a substantially L-shaped structure. The pivot coupling devices 30 each further includes an axle 33 attached to or provided on a middle portion 34 thereof and pivotally or rotatably coupled to the bearing supports 13 of the stationary supporting stand 10, for stably supporting and coupling the table 20 to the stationary supporting stand 10. A bracket 35 may be attached to or formed or provided on the free end portion of the other arm 32 of each of the pivot coupling devices 30.

Figure 5:
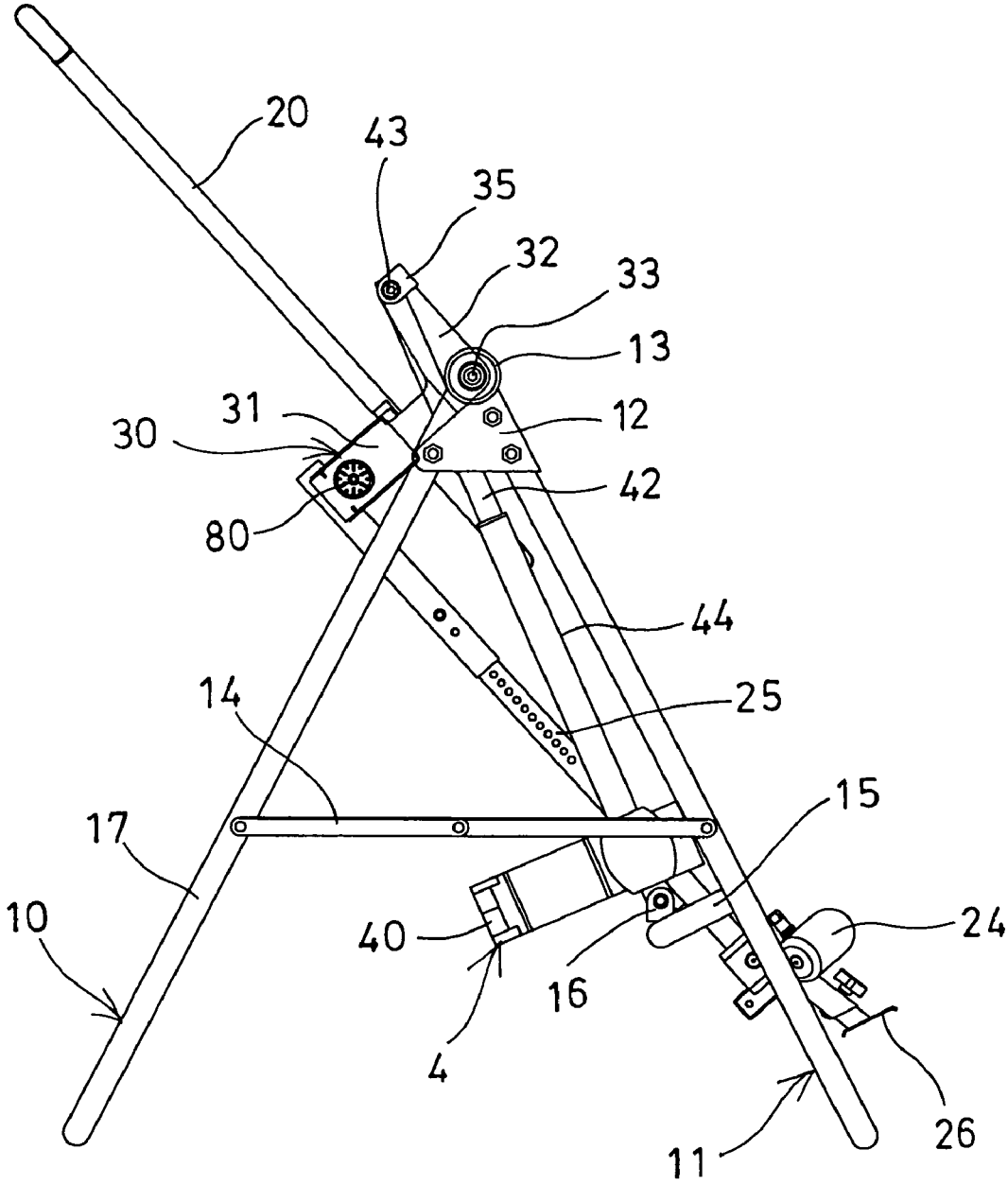
FIG. 5 is a side plan schematic view of the tilting inversion exerciser.
Figure 6:
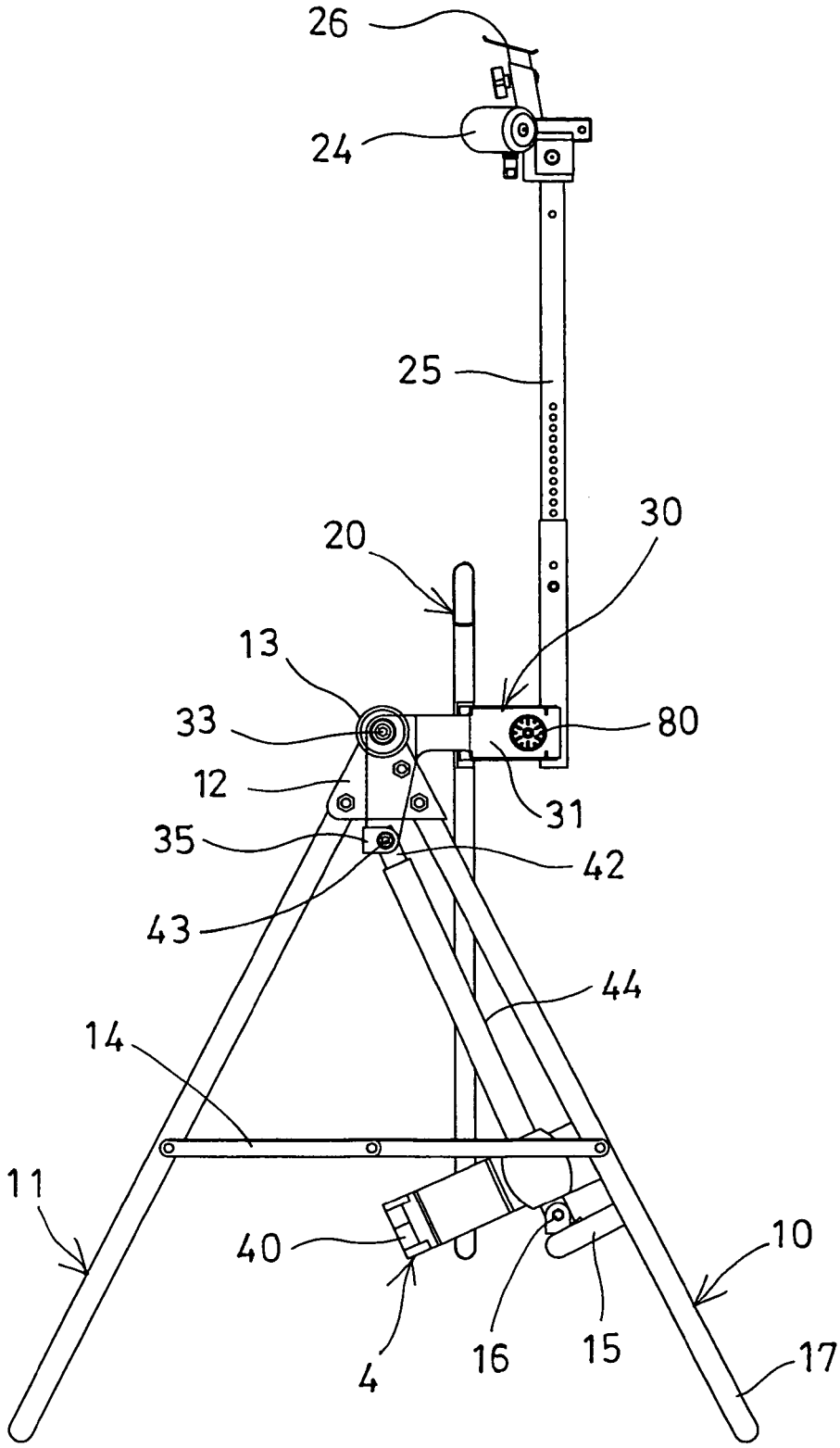
FIGS. 6, 7 are side plan schematic views similar to FIG. 5, illustrating the operation of the tilting inversion exerciser.
Figure 7:
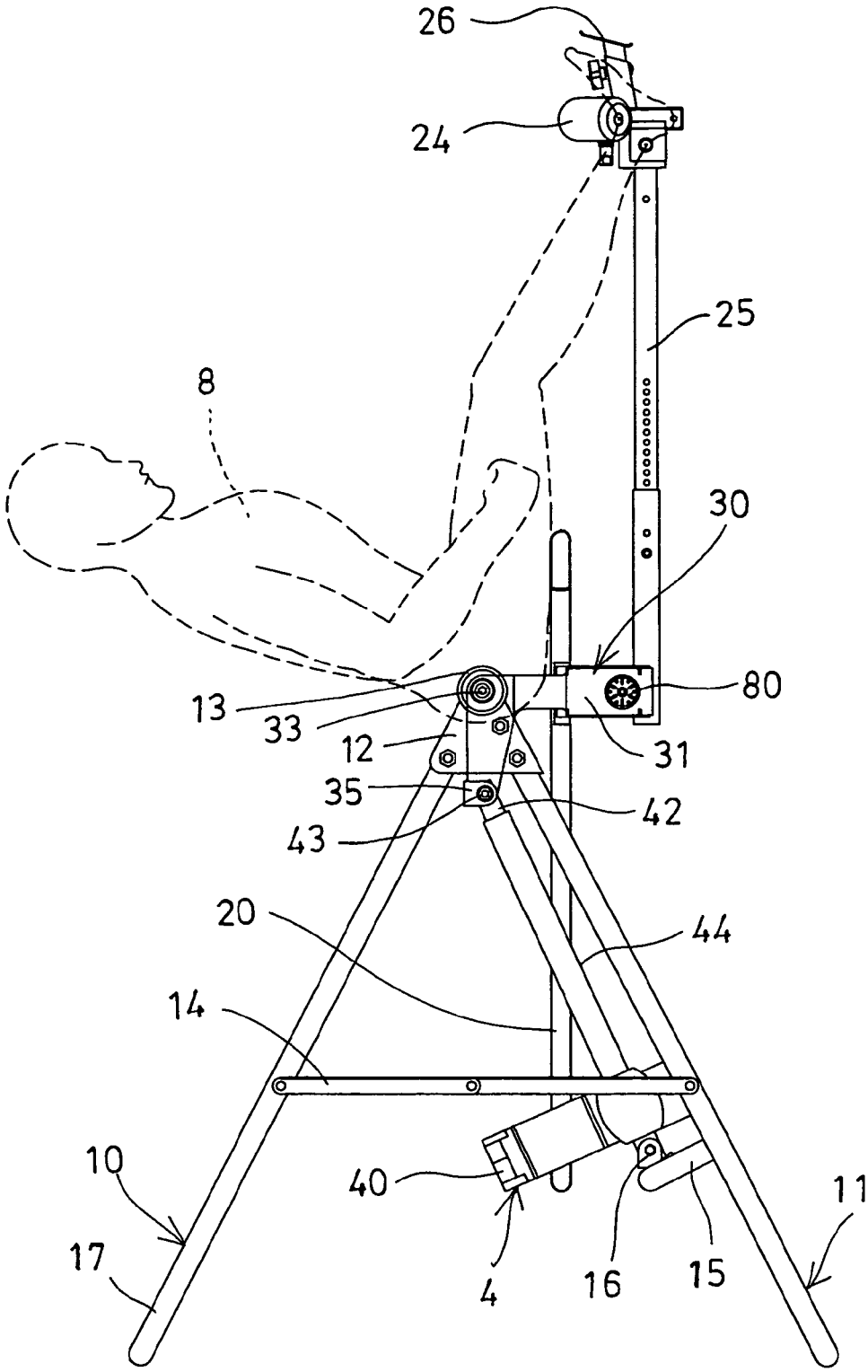

It is to be noted that, as shown in FIGS. 5-7, the table 20 is attached to or coupled to the bearing supports 13 of the stationary supporting stand 10 with the arms 31 and the axles 33 of the pivot coupling devices 30 such that the table 20 may be offset from the bearing supports 13 of the stationary supporting stand 10 and the axles 33 of the pivot coupling devices 30, and such that the center of gravity of both the table 20 and the user 8 will be located at or close to the center of gravity of the stationary supporting stand 10 (FIG. 7), and such that the tilting inversion exerciser in accordance with the present invention may be stably operated particularly when the user is conducting the inversion exercises.

A power rotating or driving means or device 4 is provided for rotating or driving or tilting the table 20 relative to the lower supporting stand 10 and for allowing the table 20 to be rotated relative to the lower supporting stand 10 to a vertical position relative to the lower supporting stand 10 and the ground (FIGS. 6, 7), and includes a motor 40 pivotally or rotatably attached or secured to the bracket 16 of the lower supporting stand 10, and a bolt or threaded member 41 (FIG. 2) threaded with a tube 42 that may be pivotally coupled to the bracket 35 or the free end portion of the other arm 32 of one of the pivot coupling devices 30 with such as a pivot pin 43, and thus for adjustably coupling the pivot coupling devices 30 and thus the table 20 to the lower supporting stand 10.

The bolt or threaded member 41 is coupled to and rotated and driven by the motor 40, for allowing the threaded member 41 and the tube 42 to be extended or retracted relative to each other by the motor 40, and thus for rotating the pivot coupling devices 30 and thus the table 20 relative to the lower supporting stand 10. It is preferable that the power rotating or driving device 4 further includes a protective outer covering or sheath or barrel or sleeve 44 attached to or extended from the motor 40 and engaged onto the threaded member 41 and also partially engaged onto the tube 42 for shielding and protecting the threaded member 41 and for preventing the threaded member 41 from being exposed and damaged by dirt and also for preventing people from being hurt by the threaded member 41.

In operation, as shown in FIG. 5, the user may be supported on the table 20 and may have his ankle portion detachably attached to or secured to the table 20 with the ankle holder 24. The power rotating or driving device 4 may be used as a rotating or actuating or operating means to rotate the pivot coupling devices 30 and thus the table 20 relative to the lower supporting stand 10, to allow the table 20 to be rotated to a position completely perpendicular to the ground (FIGS. 6, 7), and to allow the user to be freely suspended above the ground to comfortably conduct the tilting inversion exercises when the table 20 is vertically supported on the lower supporting stand 10.

Alternatively, the power rotating or driving device 4 may include an actuator (not shown), such as a pneumatic or hydraulic cylinder pivotally or rotatably attached or secured to the bracket 16 of the lower supporting stand 10, and includes a piston rod (not shown) extended therefrom and coupled to the bracket 35 or the free end portion of the other arm 32 of one of the pivot coupling devices 30 for rotating the pivot coupling devices 30 and thus the table 20 relative to the lower supporting stand 10 to any selected angular positions.

It is to be noted that, with the coupling of the pivot coupling devices 30 to the table 20, the tube 42 is required to be extended or moved relative to the lower supporting stand 10 for only a short moving stroke, by the motor 40 of the power rotating or driving device 4, to allow the table 20 to be rotated to the position completely perpendicular to the ground, and to allow the center of gravity of both the table 20 and the user 8 to be located on or closer to the center of gravity of the supporting stand 10, and thus for allowing both the supporting table and the user to be stably supported on the supporting stand 10 particularly when the user is conducting the inversion exercises.

It is further to be noted that the table 20 is attached or coupled to the bearing supports 13 of the stationary supporting stand 10 with the arms 31 and is thus offset from the axles 33 and the bearing supports 13 of the stationary supporting stand 10, and the tube 42 of the power rotating or driving device 4 is coupled to the bracket 35 or the free end portion of the other arm 32 of one of the pivot coupling devices 30 that is also offset from and the axles 33 and the bearing supports 13 of the stationary supporting stand 10 such that the power rotating or driving device 4 may rotate or tilt the table 20 and the user 8 relative to the stationary supporting stand 10 with a smaller force.

Accordingly, the tilting inversion exerciser in accordance with the present invention includes a power rotating or driving device for rotating the tilting inversion exerciser relative to the supporting stand and for allowing the table to be rotated relative to the lower support to the vertical position relative to the lower support and the ground, and thus for allowing the user to conduct the inversion exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A tilting inversion exerciser comprising: a supporting stand including a lever and at least two legs, a motor attached to said supporting stand, a table for supporting a user thereon, said table including two side portions, a first pivot coupling device and a second pivot coupling device each including an axle provided on a middle portion thereof for pivotally attaching to a bearing support of said supporting stand, and each including a first arm extended therefrom and secured to said side portions of said table respectively, for allowing said table to be offset from said axles of said pivot coupling devices, said first pivot coupling device including a second arm extended therefrom and bent relative to said first arm for forming a substantially L-shaped structure, and a motor-driven threaded member for coupling a first end to said second arm of said first pivot coupling device, said threaded member having a second opposite end coupled to said motor and rotated and driven by said motor for rotating said pivot coupling device and said table relative to said supporting stand, said motor affixed to a bracket on said lever.

2. The tilting inversion exerciser as claimed in claim 1, wherein said supporting stand includes at least two bearing supports disposed on an upper portion of said supporting stand for pivotally attaching said axles.

3. The tilting inversion exerciser as claimed in claim 1, wherein said table includes an ankle holder attached thereto, for securing ankle portions of the user to said table.

4. A tilting inversion exerciser comprising: a supporting stand, a table for supporting a user thereon, said table including two side portions, a first pivot coupling device and a second pivot coupling device each including an axle provided on a middle portion thereof for pivotally attaching to a bearing support of said supporting stand, and each including a first arm extended therefrom and secured to said side portions of said table respectively, for allowing said table to be offset from said axles of said pivot coupling devices, and said pivot coupling device including a second arm extended therefrom and bent relative to said first arm for forming a substantially L-shared structure, a motor-driven threaded member having a first end for coupling to said second arm of said first pivot coupling device and for rotating said pivot coupling device and said table relative to said supporting stand, and a tube pivotally coupled to said second arm of said first pivot coupling device and threaded with said threaded member.

5. The tilting inversion exerciser as claimed in claim 4, wherein said second arm of said first pivot coupling device includes a bracket provided on a free end portion for coupling to said tube.

6. A tilting inversion exerciser comprising: a supporting stand, a table for supporting a user thereon, said table including two side portions, a first pivot coupling device and a second pivot coupling device each including an axle provided on a middle portion thereof for pivotally attaching to a bearing support of said supporting stand, and each including a first arm extended therefrom and secured to said side portions of said table respectively, for allowing said table to be offset from said axles of said pivot coupling devices, and said pivot coupling device including a second arm extended therefrom and bent relative to said first arm for forming a substantially L-shaped structure, a motor-driven threaded member for coupling to said second arm of said first pivot coupling device and for rotating said pivot coupling device and said table relative to said supporting stand, and a sleeve extended from said motor and engaged onto said threaded member for shielding and protecting said threaded member.

7. A tilting inversion exerciser comprising: a supporting stand, a table for supporting a user thereon, said table including two side portions, a first pivot coupling device and a second pivot coupling device each including an axle provided on a middle portion thereof for pivotally attaching to a bearing support of said supporting stand, and each including a first arm extended therefrom and secured to said side portions of said table respectively, for allowing said table to be offset from said axles of said pivot coupling devices, and said pivot coupling device including a second arm extended therefrom, said first arm and said second arm of said first pivot coupling device forming an L-shaped structure, and a motor-driven threaded member for coupling to said second arm of said first pivot coupling device and for rotating said pivot coupling device and said table relative to said supporting stand.

* * * * *